US006105263A

United States Patent [19]

Stones et al.

[11] Patent Number: 6,105,263

[45] Date of Patent: Aug. 22, 2000

[54] CLUTCH MECHANISM FOR A CHAIN SAW

[75] Inventors: Kevin Stones, Bishop Auckland; Martyn Riley, Newcastle, both of United Kingdom

[73] Assignee: Black & Decker, Inc., Neward, Del.

[21] Appl. No.: 09/261,774

[22] Filed: Mar. 3, 1999

[30] Foreign Application Priority Data

Mar. 6, 1998 [GB] United Kingdom ..... 9804796

[51] Int. Cl.[7] ..... B27B 17/02

[52] U.S. Cl. ..... 30/382; 30/383

[58] Field of Search ..... 30/381–383; 188/77 W

[56] References Cited

U.S. PATENT DOCUMENTS

| | | | |
|---|---|---|---|
| 1,193,008 | 8/1916 | Fuller . | |
| 1,988,590 | 1/1935 | Geiger . | |
| 2,332,743 | 10/1943 | Morris . | |
| 3,361,165 | 1/1968 | Irgens | 30/382 UX |
| 4,352,418 | 10/1982 | Teraoka . | |
| 4,625,406 | 12/1986 | Fushiya . | |
| 4,782,593 | 11/1988 | Kieser et al. | 30/382 |
| 5,709,032 | 1/1998 | Mizutani et al. | 30/382 X |
| 5,791,057 | 8/1998 | Nakamura et al. | 30/382 X |

*Primary Examiner*—Douglas D. Watts
*Attorney, Agent, or Firm*—Ajay K. Gambhir; John D. DelPonti

[57] ABSTRACT

A chain saw is provided that comprises a motor which rotatingly drives a cutting chain via a sprocket mounted on a spindle (34) via a clutch mechanism. When the clutch mechanism (17) is engaged, a pivotal handle guard (22) interacts with the clutch mechanism to disengage the clutch mechanism (17). The clutch mechanism is biased towards disengagement. An actuating means (8, 68) is provided such as a switch which is releasably connected via a pin located within a groove to the clutch mechanism (17). The actuating means can override the biasing force to engage the clutch (17) when the actuating means (8, 68) is connected to the clutch (17). The pivotal handle guard (22) is configured so that it interacts with the pin wherein, when the pivotal handle guard (22) is activated, it detaches the actuating means (8, 68) from the clutch mechanism (17) by knocking the pin out of the groove.

9 Claims, 16 Drawing Sheets

CLUTCH MECHANISM FOR A CHAIN SAW

The present invention relates to a clutch mechanism for a power tool and to the mechanism by which the clutch mechanism interacts with a safety handle, and in particular, to a clutch mechanism for a chain saw and to the mechanism by which it interacts with a pivotal handle guard and a sliding engagement switch.

A chain saw comprises a cutting chain which is driven around a chain bar by a motor. The motor can be either an internal combustion engine or an electric motor. The chain saw is supported by an operator in use by two handles, a first rear handle located at the rear of the main body of the chain saw and a second bail handle located on the side of the main body of the chain saw. The chain saw is usually operated by a trigger switch on the rear handle.

The operation of a chain saw to cut material can be hazardous. One well known hazard is that generally referred to as "kick back". During use, the moving chain cuts through the material. However, the chain can become snagged or caught on the material thus preventing the chain from moving relative to the material. This results in the chain saw being thrown by the force of the motor trying to drive the chain, upwards towards the head of the operator which is known as "kick back". It is therefore desirable to stop the chain as soon as possible when "kick back" occurs.

Current safety standards in Europe require that the chain on a chain saw has to stop within a pre-determined period of time when "kick back" occurs. The stopping process is commonly triggered by the forward pivotal movement of a pivotal handle guard located in front of the bail handle. The forward pivotal movement of the handle guard can be caused by the back of the hand of the operator holding the bail handle hitting the handle guard as the chain saw "kicks back". Alternatively, the handle guard can be designed so that it has sufficient moment of inertia to cause it to pivot forward when the chain saw "kicks back".

Chain saws are commonly constructed so that the drive mechanism for the cutting chain comprises a clutch mechanism. One known type of such a clutch mechanism is that of a dog clutch. The handle guard is configured so that its forward pivotal movement during "kick back" disengages the clutch, disconnecting the drive to the chain. The clutch is re-engaged by the rearward pivotal movement of the handle guard. The chain runs to a halt due to the friction between the chain and the chain bar. In existing designs of chain saw complicated lever mechanisms are required between the pivotal handle guard and the clutch mechanism. The complicated lever mechanisms are expensive to produce and take up valuable space.

The clutch mechanisms are often further complicated by the addition of a braking mechanism such as a band brake. This requires further complicated lever mechanisms which take up additional space and incur additional costs.

It is an object of the present invention to provide a simple but reliable design of clutch mechanism which interacts with the pivotal handle guard in a simple but reliable manner. It is a further object of the present invention to provide a simple but reliable design of clutch mechanism which can be also engaged or disengaged by a separate switching mechanism.

According to the present invention there is provided a chain saw comprising a motor which rotatingly drives a spindle via a clutch mechanism when the clutch mechanism is engaged and a movable handle guard which interacts with the clutch mechanism to disengage the clutch mechanism characterised in that the clutch mechanism is biased towards disengagement and there is further provided an actuating means which is releasably connected to the clutch mechanism and which can override the biasing force to engage the clutch mechanism when the actuating means is connected to the clutch mechanism, the movable handle guard being configured so that it interacts with the connection between the actuating means and clutch mechanism wherein, when the movable handle guard is activated, the movable handle guard detaches the actuating means from the clutch mechanism.

Preferably, the movement of the movable handle guard is pivotal. By constructing the chain saw in this manner, a clutch is provided which can be interacted with for engagement or disengagement by the actuating means in addition to the movable handle guard. Furthermore, the construction allows the actuating means and the movable handle guard interact with the clutch mechanism by a single mechanism. This therefore simplifies the design of chain and furthermore, allows a simple design of clutch mechanism to be used.

Preferably the movable handle guard is configured so that, when the actuating means is detached from the clutch mechanism, the actuating means is prevented from being re-attached until the movable handle guard has been reset. This ensures that a user resets the movable handle guard prior to being able to apply any drive force to the chain. Therefore a user is prevented from using the chain saw without the movable handle guard being set in a correct position so as to provide protection to the user in the event of "kick back".

Preferably, the clutch mechanism comprises a gear actuator pivotal between a first position where the clutch mechanism is engaged and a second position where the clutch mechanism is disengaged, the gear actuator having an arm which extends away from the axis of pivot, a slot formed in the end of the arm, a groove formed in the slot, the actuating mechanism comprising a peg capable of sliding along the slot and into or out of the groove and configured so that, when the peg is located within the groove, the actuating mechanism is capable of pivoting the gear actuator to the first position, and the movable handle guard comprising means to move the peg out of the groove into the slot when the movable handle guard is activated, the gear actuator being free to pivot between the first and second positions when the peg is located within the slot. For such a clutch mechanism it is preferable that the clutch mechanism is biased towards disengagement by a spring which biases the gear actuator towards the second position.

Preferably the peg is formed from a rod which extends beyond the groove or slot and the means to move the peg comprises a guard actuator attached to a movable handle guard and which is located alongside the gear actuator and configured so that, when the movable handle guard is activated, it engages with a part of the rod which extends beyond the gear actuator to move the rod from the groove into the slot.

It is desirable that, when the movable handle guard is activated the guard actuator moves to a position in which the rod is prevented from re-entering the groove until the movable handle guard is reset.

Preferably the gear actuator comprises a spring which biases the rod into the groove when the rod is located at the entrance of the groove. The spring can be integrally formed with the gear actuator. One type of actuating mechanism comprises a switch slidable between a first position where it engages the clutch mechanism and a second position where it disengages the clutch.

The use of a slidable switch provides an easy way to engage or disengage the clutch and which requires a low force having to be applied to the sliding switch by the user, making the chain saw more user friendly.

The invention will now be described in relation to the drawings of which:

Figure 1:
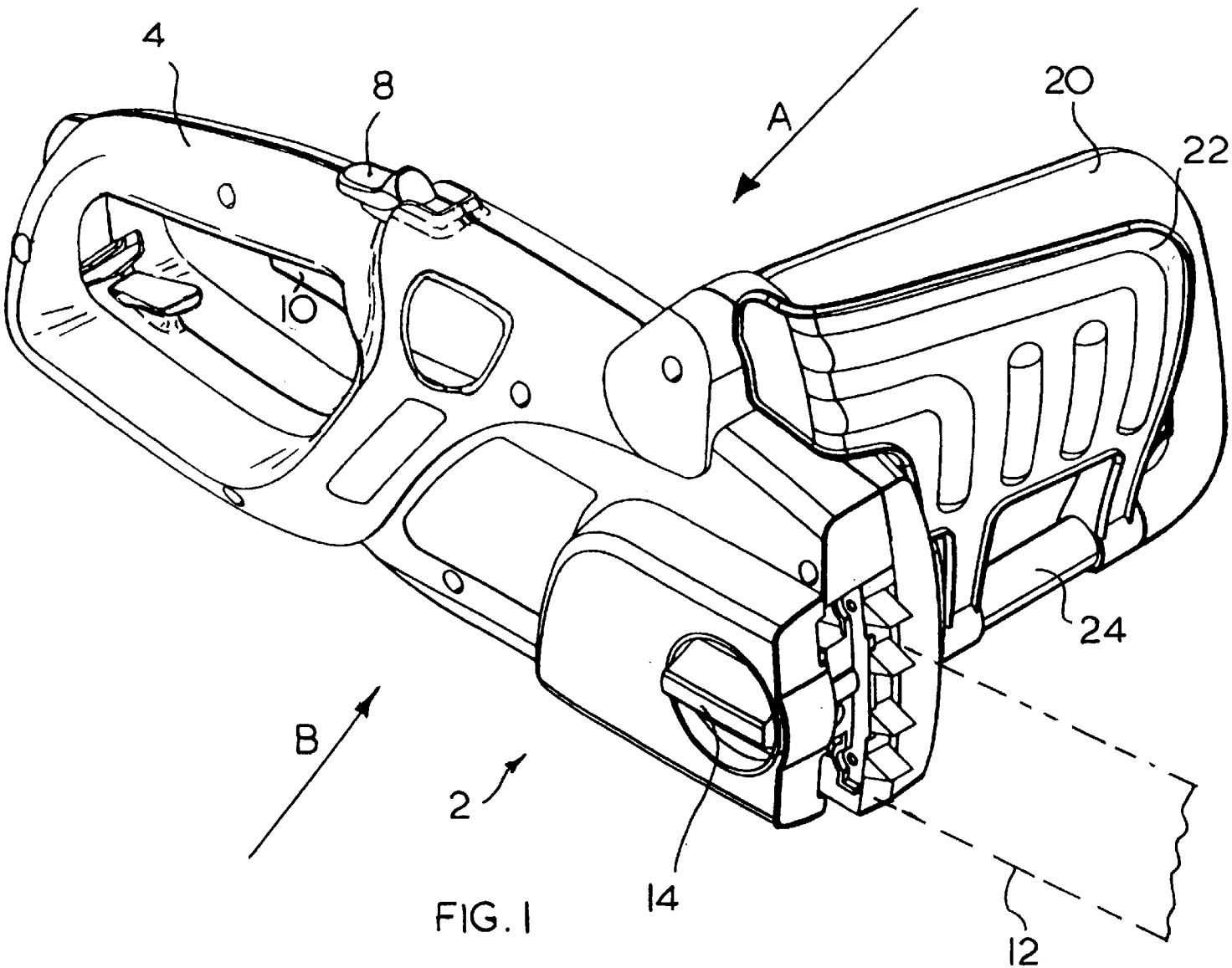
FIG. 1 shows a perspective view of a chain saw (excluding the chain bar and chain)
Figure 2:
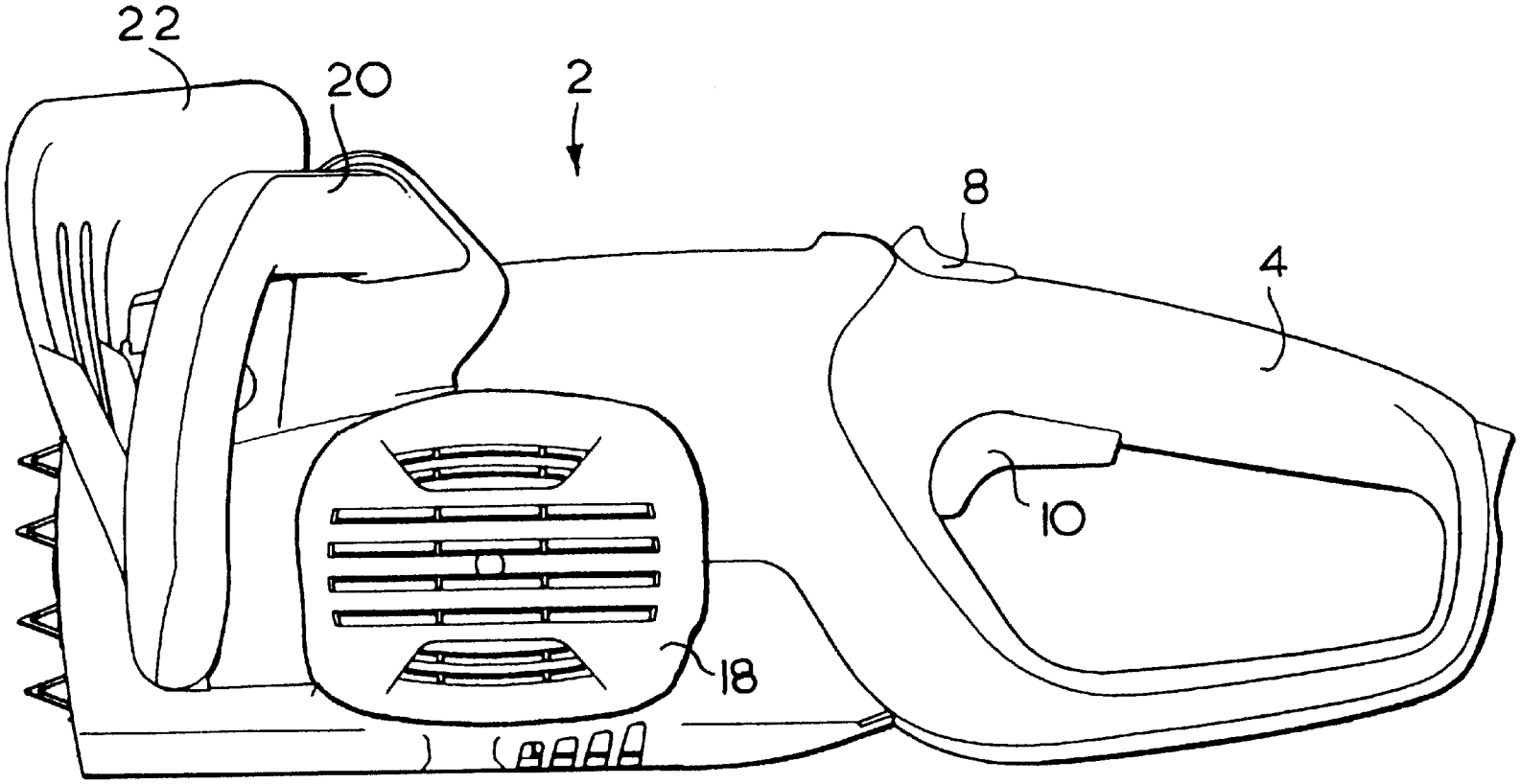
FIG. 2 shows a side view of a chain saw as seen from the side generally indicated by Arrow A in FIG. 1.
Figure 3:
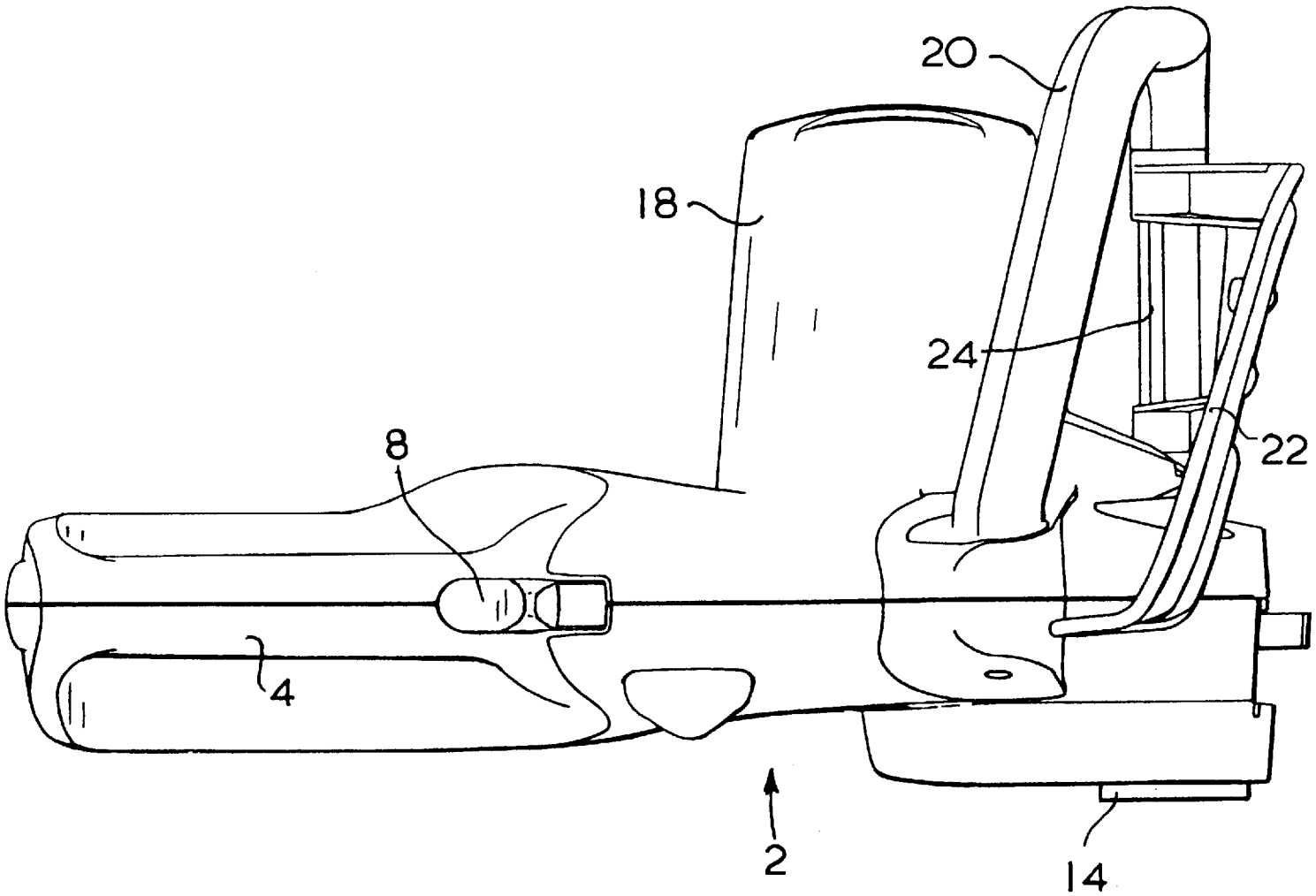
FIG. 3 shows a top view of a chain saw.
Figure 4:
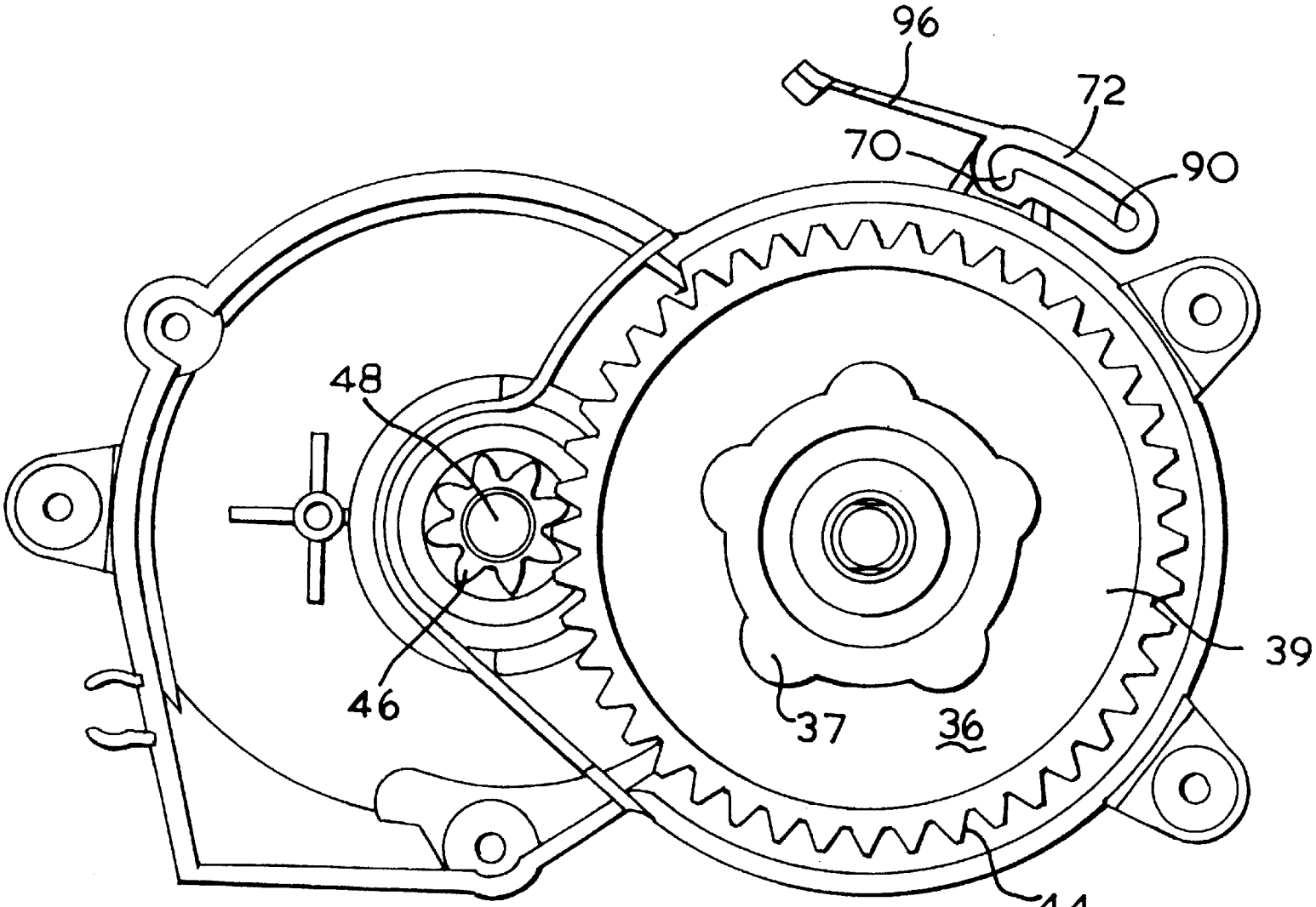
FIG. 4 shows a side view of the dog clutch when it is disengaged.

Referring to FIGS. 1 to 3, the chain saw comprises a central body portion (generally indicated by reference number (2)) having a rear handle (4) attached to the rear of the central body portion (2), a sliding switch (8) mounted on the top of the rear handle (4), a trigger switch (10) mounted in the central aperture formed by the rear handle (4), a chain tensioner (not shown) which moves a chain bar (12) (indicated by the dashed lines in FIG. 1) to tighten a cutting chain (not shown) which runs around the chain bar (12) in a known way and which is operated by the rotation of a knob (14), an electric motor (not shown) which drives the chain saw via a clutch mechanism and which is housed in a hood (18), a front bail handle (20) attached to the side of the central body portion (2) in front of the hood (18) and a movable handle guard (22) (hereinafter referred to as a pivotal handle guard) which pivots about the base portion (24) of the front bail handle (20) about a substantially horizontal axis of pivot.

In use the electric motor drives the chain of the chain saw via a clutch mechanism (17). The electric motor rotatingly drives the clutch mechanism (17) which, when engaged, rotatingly drives a sprocket (not shown) around which is wrapped part of the chain. When the clutch mechanism (17) is disengaged, the sprocket and therefore the chain remain stationary regardless of whether the motor is running or not. The clutch mechanism (17) is biased by a spring (26) towards the disengaged position. The clutch mechanism (17) is engaged or disengaged by the movement of the sliding switch (8) which is linked mechanically to the clutch mechanism (17). The clutch mechanism (17) is engaged by sliding the sliding switch (8) forward to a forward position and disengaged by allowing the sliding switch to slide back due to a biasing force to a rearward position. The sliding switch (8) is further configured so that the trigger switch (10) cannot be depressed, thereby preventing the flow of electrical current to the electric motor, until the sliding switch (8) is in the forward position.

Figure 17:
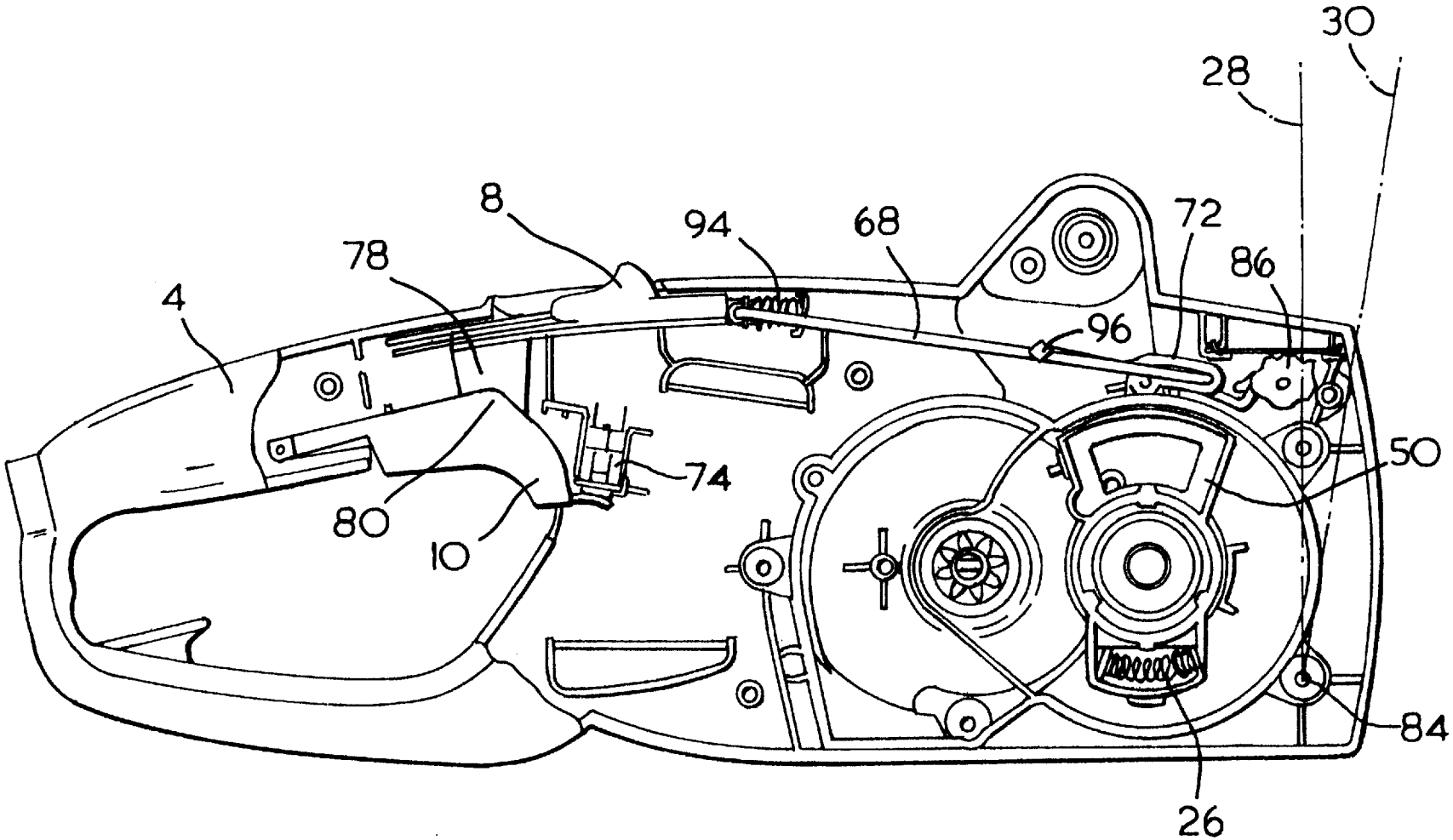
FIG. 17 shows a schematic design of a vertical cross-section of the chain saw in the plane of the gear actuator with the dog clutch disengaged due to the activation of the pivotal handle guard when viewed from the side of the chain saw in a direction generally indicated by Arrow B in FIG. 1.

The clutch mechanism is further linked to the pivotal handle guard (22). During the normal course of operation of the chain saw the pivotal handle guard (22) remains in a rear position (indicated by line 28 in FIGS. 10, 11 and 17) towards the bail handle (20). Whilst the pivotal handle guard (22) is in this position, it has no interaction with the clutch mechanism (17) thereby allowing the normal operation of the clutch mechanism (17) and hence chain saw. However, when the pivotal handle guard (22) is pivoted to a forward position (indicated by line 30), the movement disengages the sliding switch (8) from the clutch mechanism (17) thereby allowing the clutch mechanism (17) to disengage due to the biasing force of the spring (21). The forward pivotal movement of the pivotal handle guard (22) most often occurs when the chain saw "kicks back" whilst being used. When this occurs, the back of the hand of the operator holding the front bail handle (20) will make contact with and push the pivotal handle guard (22) forward, causing it to pivot to the forward position (30). The pivotal movement of the pivotal handle guard (22) will disengage the clutch mechanism (17) allowing the chain to run to a stop even while the motor continues to rotate.

The construction of the clutch mechanism (17) together with the means by which it interacts with the sliding switch (8) and pivotal handle guard (22) will now be described in greater detail.

Figure 13A:
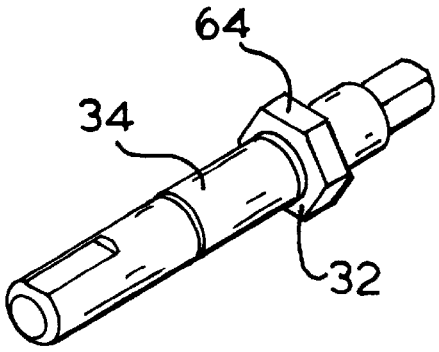
FIGS. 13A to 13B show design drawings of the driven gear rigidly marked on the driven spindle.
Figure 13B:
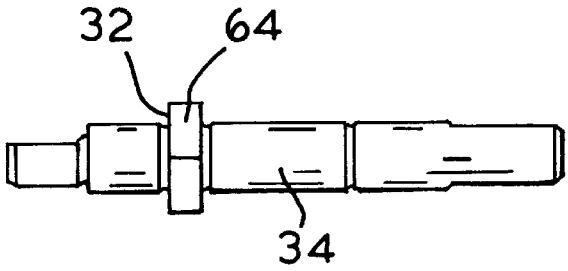
Figure 16A:
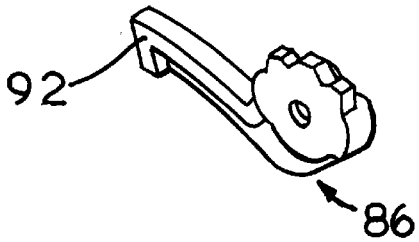
FIGS. 16A to 16B show design drawings of the guard actuator.
Figure 16B:
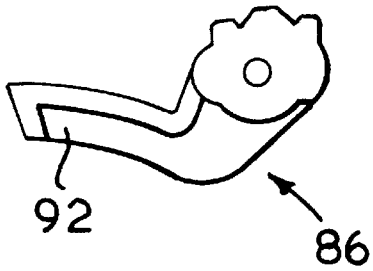
Figure 14A:
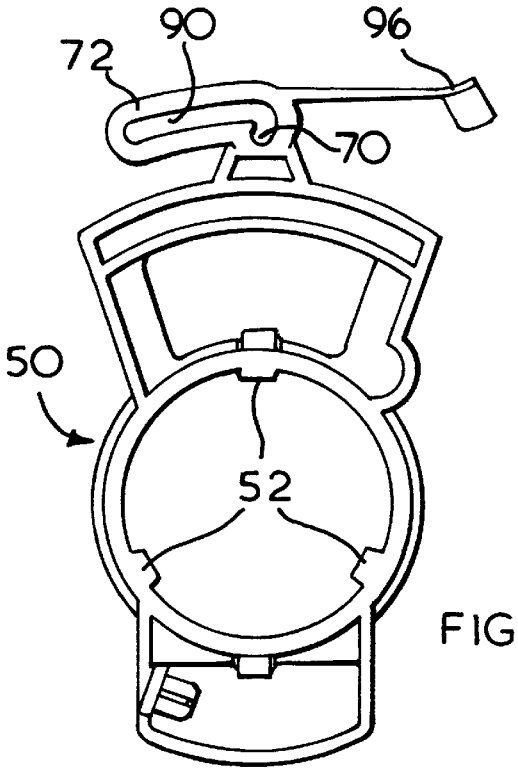
FIGS. 14A to 14D show design drawings of the gear actuator.
Figure 14B:
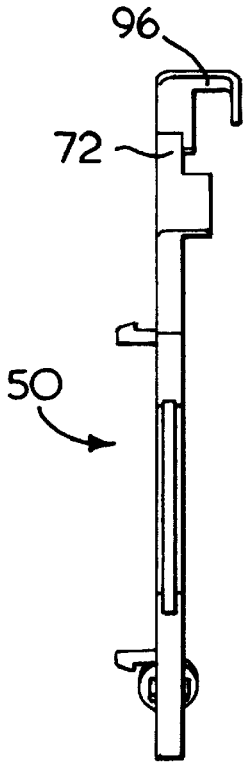
Figure 14C:
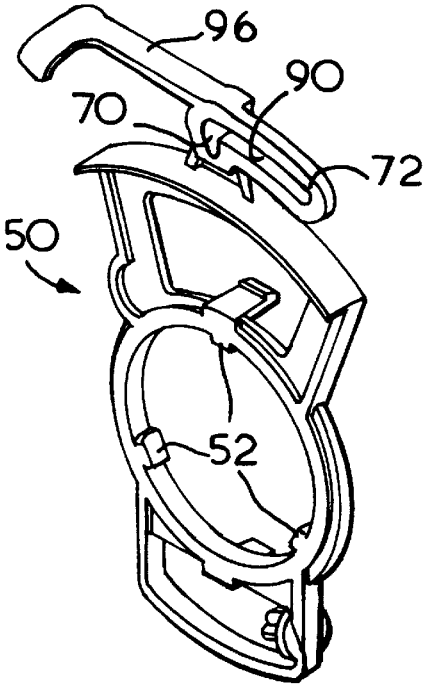
Figure 14D:
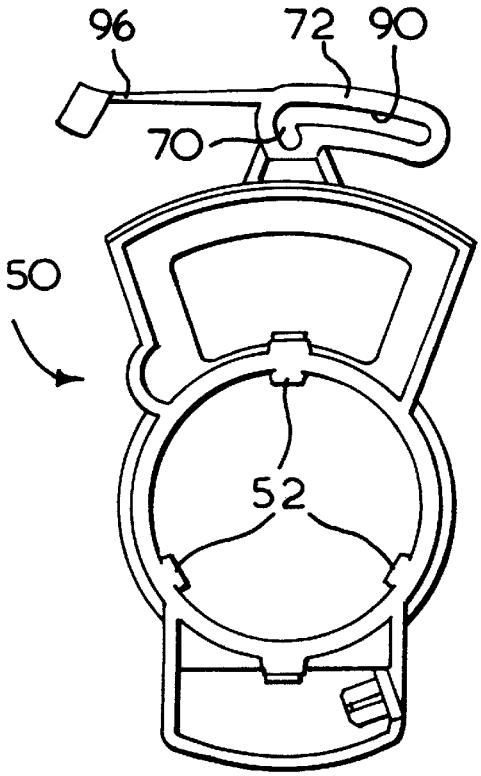
Figure 15A:
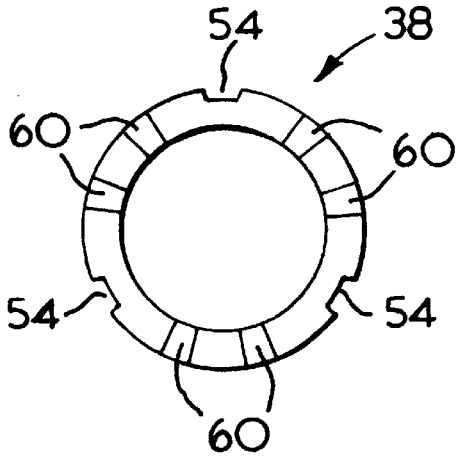
FIGS. 15A to 15D show design drawings of the cam ring.
Figure 15B:
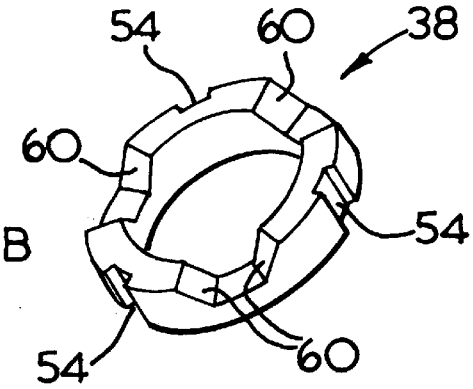
Figure 15C:
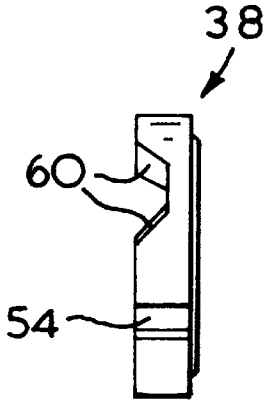
Figure 15D:
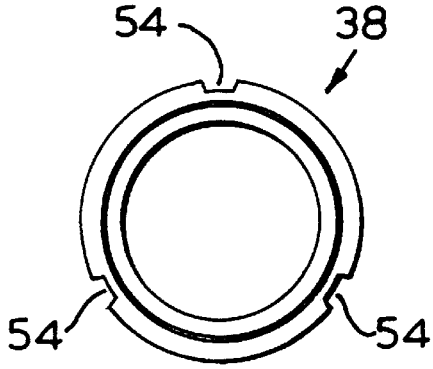

With reference to FIGS. 4 to 9, the clutch mechanism (17) is of the dog clutch variety and comprises a first driven gear (32) which is mounted on and rigidly attached to a rotatably mounted driven spindle (34), a second drive gear (36) which is rotatably mounted on and axially slidable along the driven spindle (34) adjacent to the driven gear (32) and a cam ring (38) which is rotatably mounted within a limited range of rotation about the drive gear (36). FIG. 12 shows a detailed design drawing of the drive gear (36). The drive gear (36) is manufactured from two component parts, an inner part (37) around which is formed an outer cog wheel (30). FIG. 13 shows a detailed drawing of the driven gear (32) mounted on the driven spindle (34) and FIG. 15 shows a detailed design drawing of the cam ring (38). The drive gear (36) is biased towards the driven gear 32) by a spring (40) which is located between the drive gear (36) and a wall (42) of the casing for the dog clutch (17). The outer circumference (44) of the drive gear (36) meshes with a gear (46) rigidly mounted on a rotatable drive spindle (48) of the electric motor. As the drive spindle (48) rotates about its axis, the gear (46) rotates which in turn causes the drive gear (36) to rotate. The sprocket is mounted on the driven spindle (34) which drives the chain of the chain saw (not shown).

Figure 5:
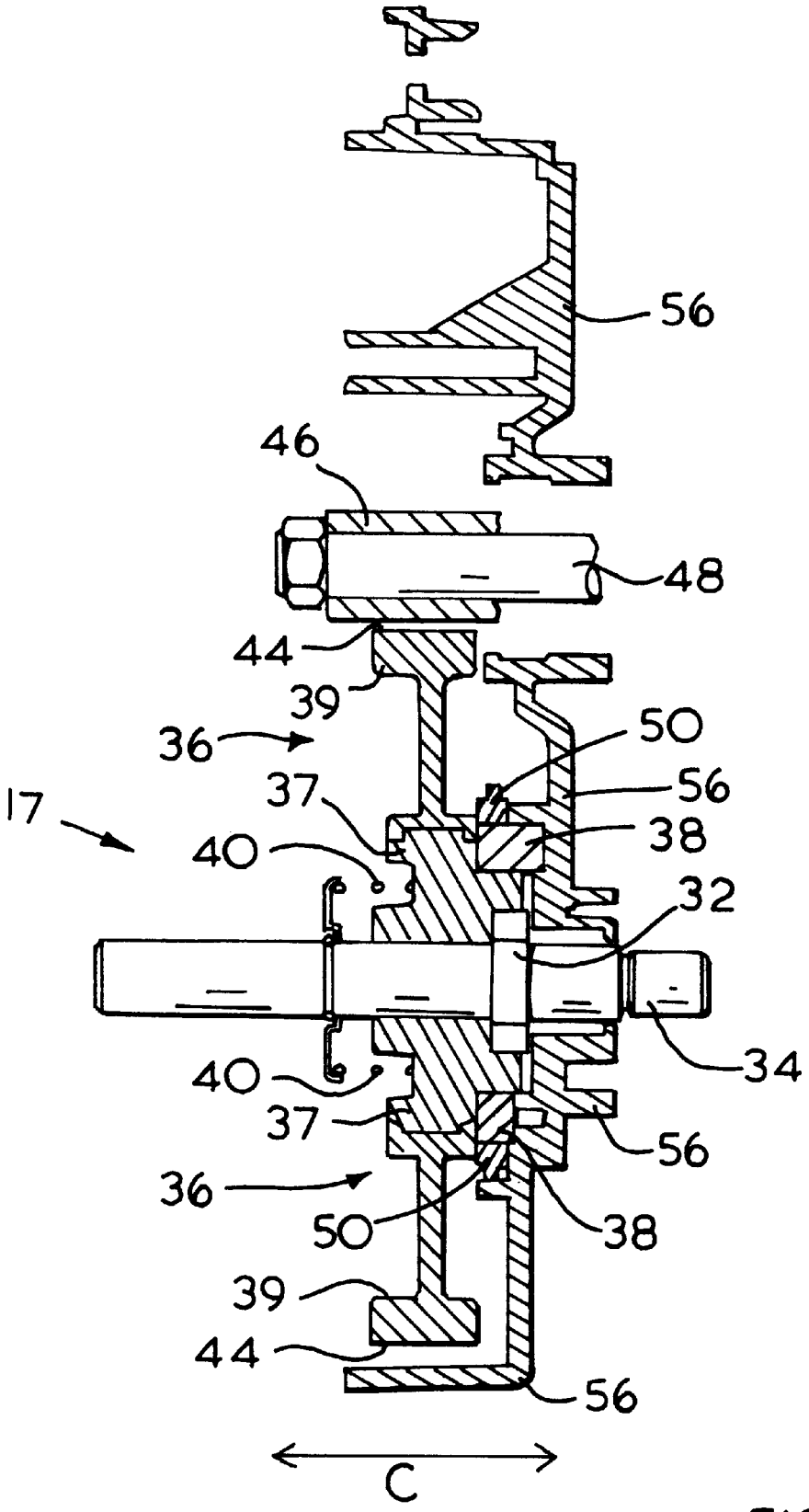
FIG. 5 shows a horizontal cross-section through the longitudinal axis of the driven spindle of the dog clutch when it is engaged by movement of the sliding switch.
Figure 7:
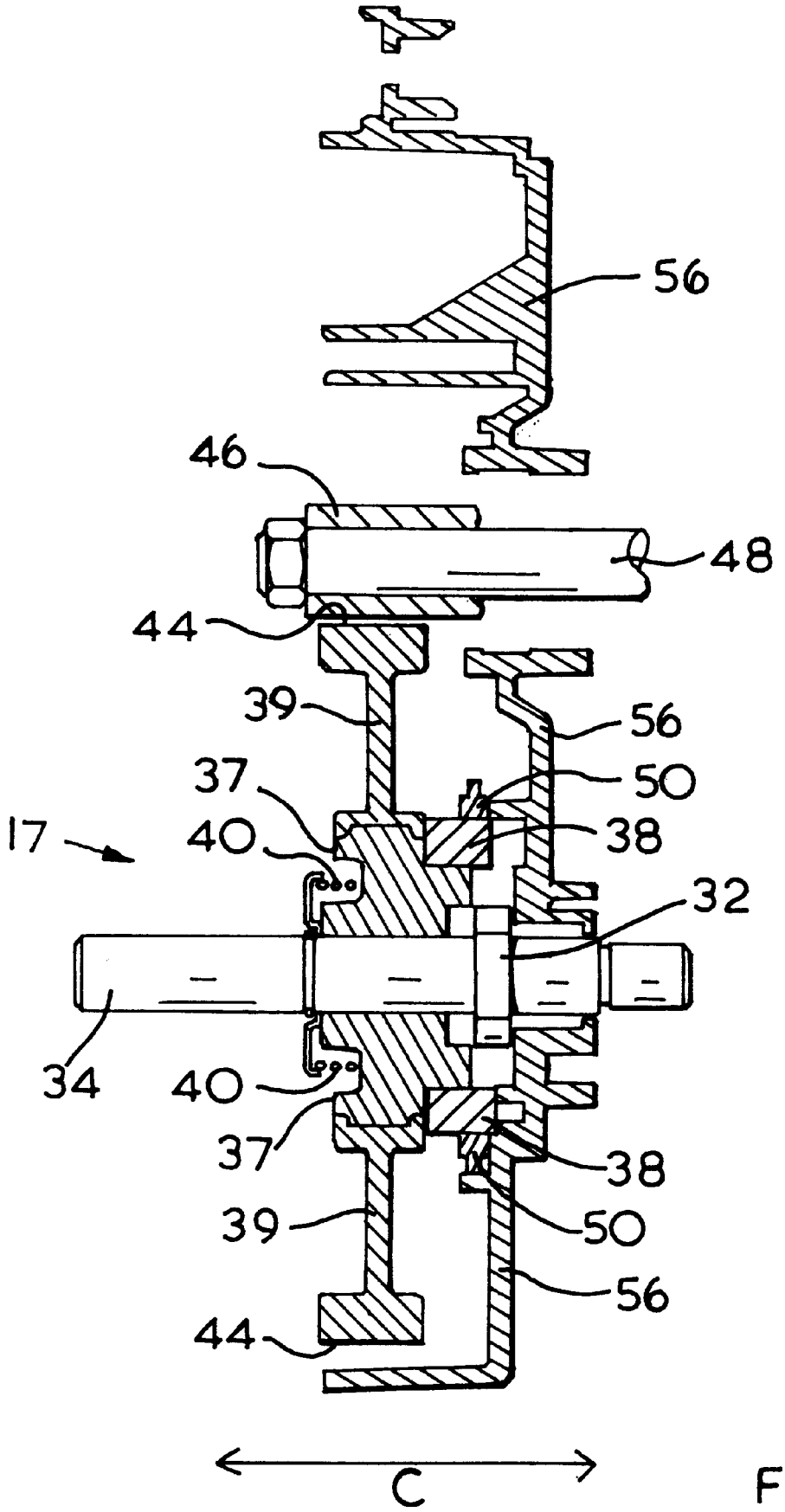
FIG. 7 shows a horizontal cross-section through the longitudinal axis of the driven spindle of the dog clutch when it is disengaged by movement of the sliding switch.
Figure 8:
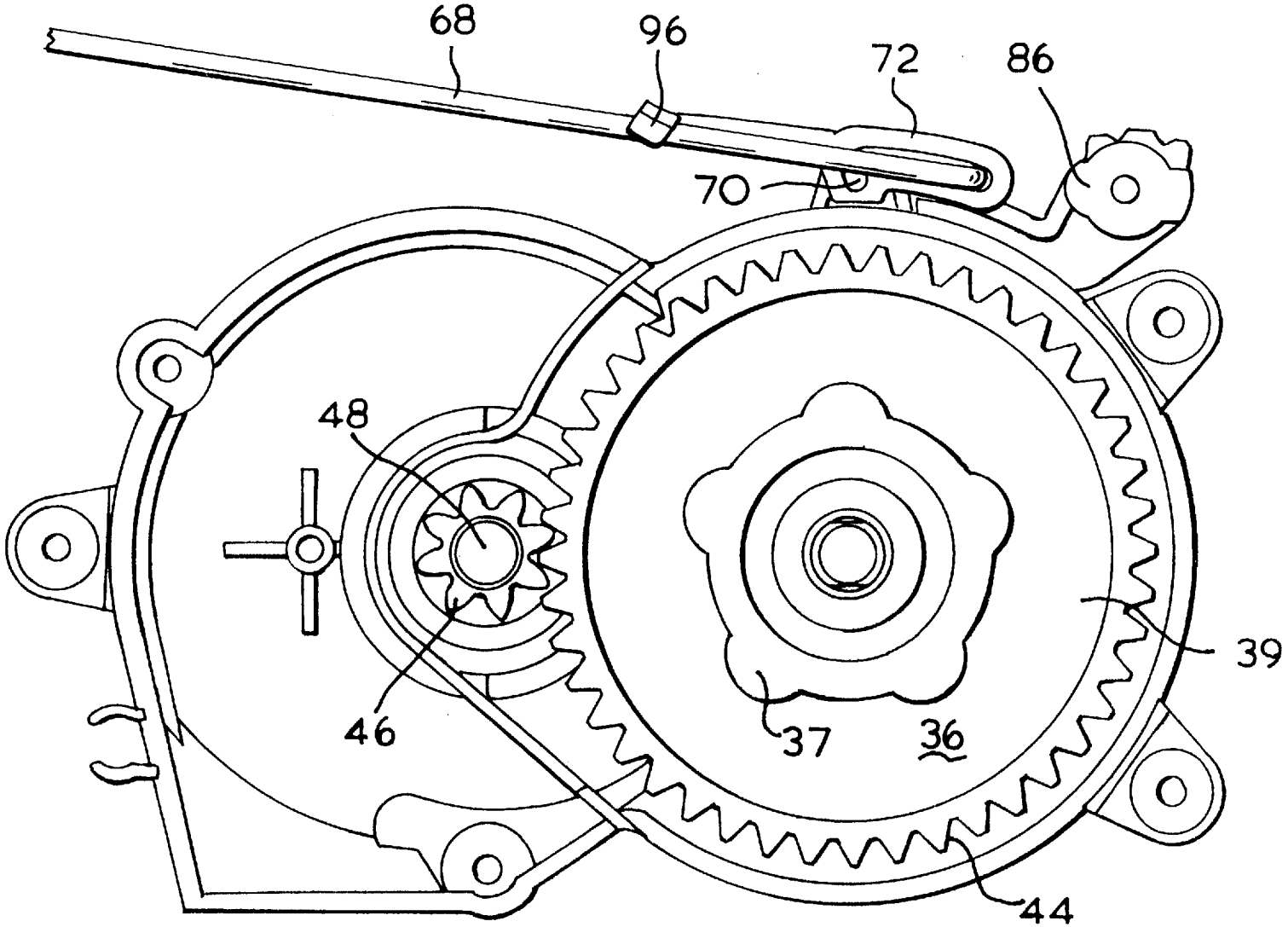
FIG. 8 shows a side view of the dog clutch when it has been disengaged by the movement of the pivotal handle guard together with the metal rod for engaging the dog clutch.
Figure 9:
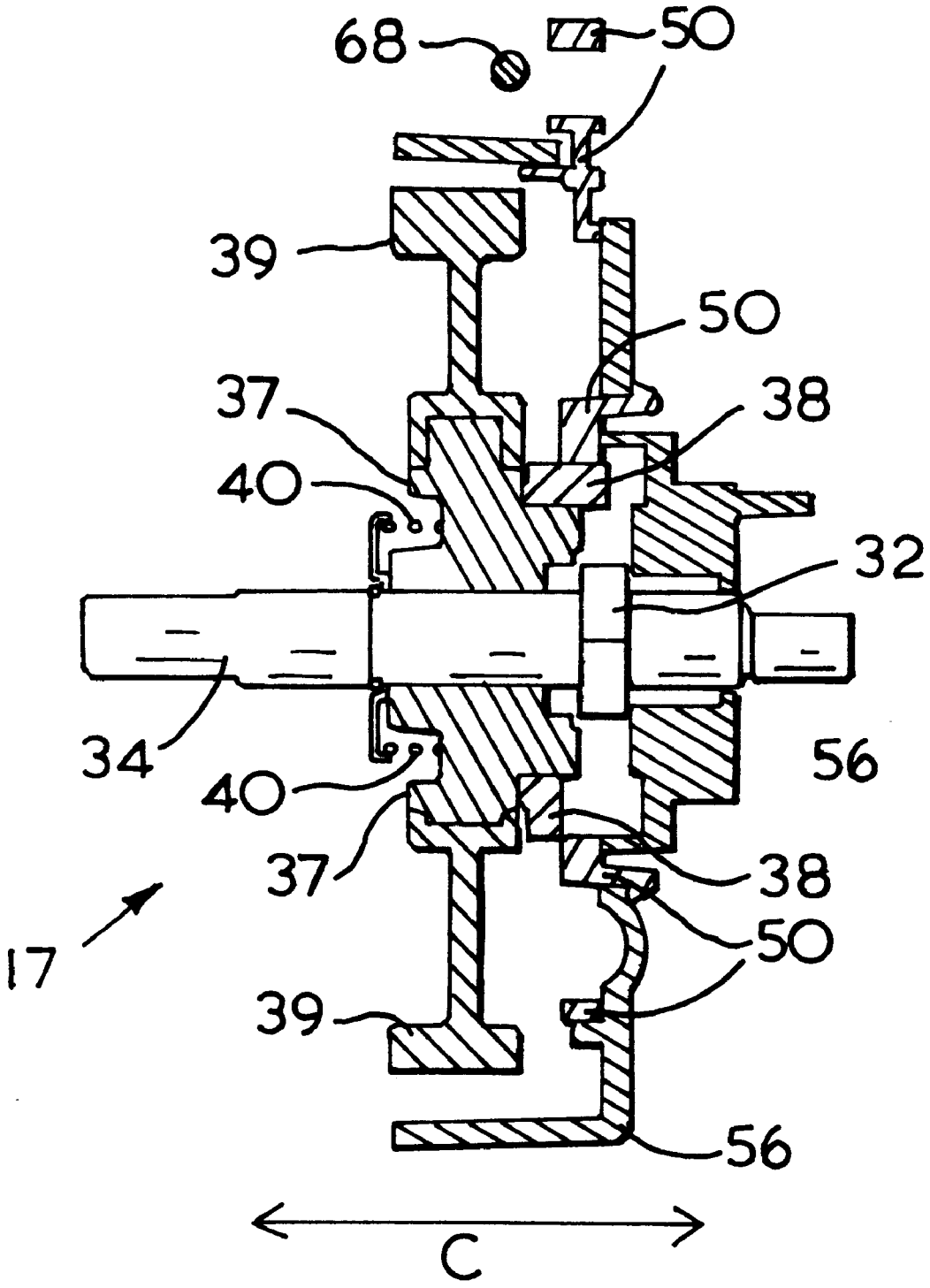
FIG. 9 shows a vertical cross-section through the longitudinal axis of the driven spindle of the dog clutch when it is disengaged by movement of the pivotal handle guard.
Figure 10:
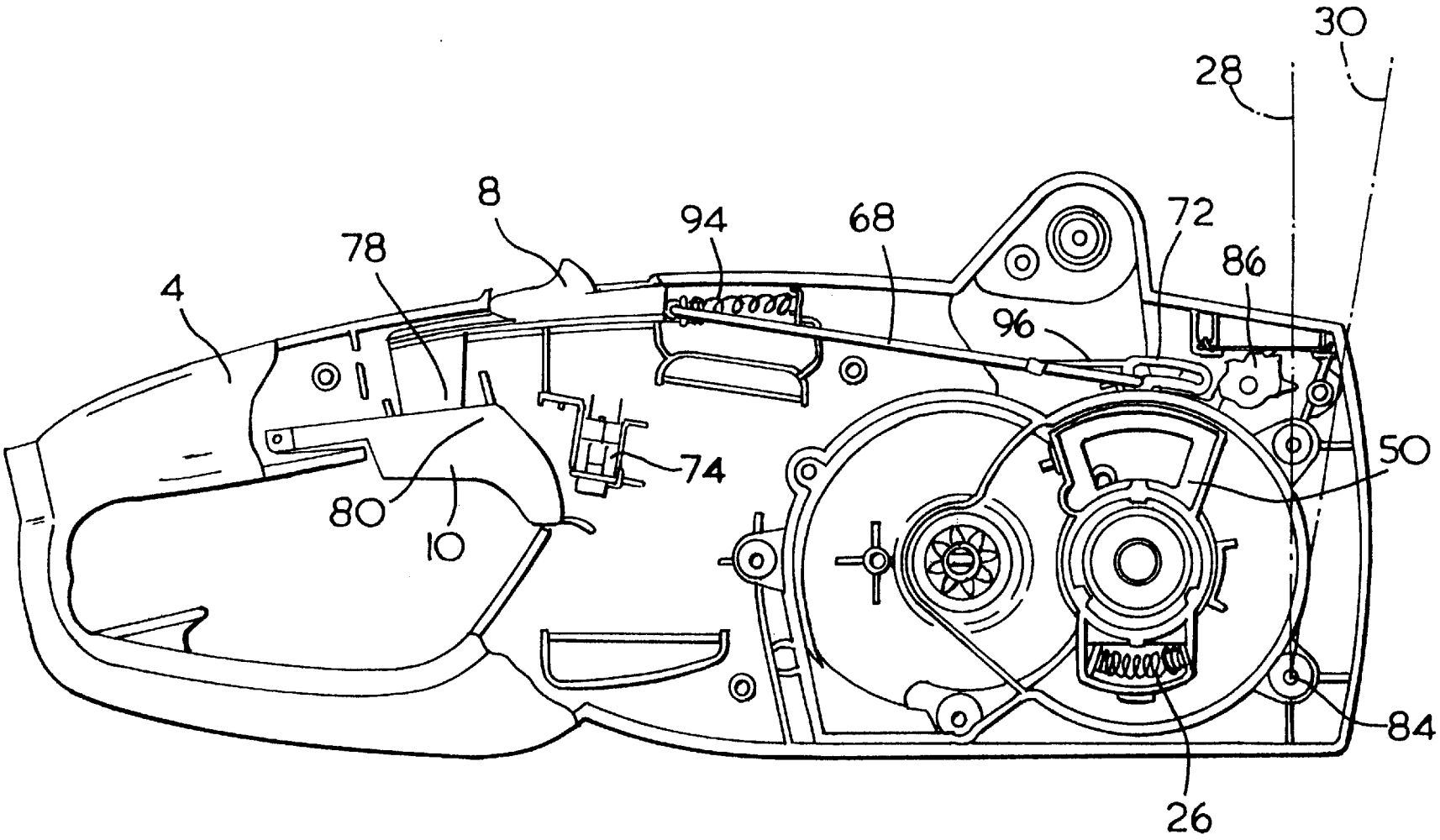
FIG. 10 shows a schematic diagram of a vertical cross-section of the chain saw in the plane of the gear actuator with the dog clutch disengaged when viewed from the side of the chain saw in a direction generally indicated by Arrow B in FIG. 1.
Figure 11:
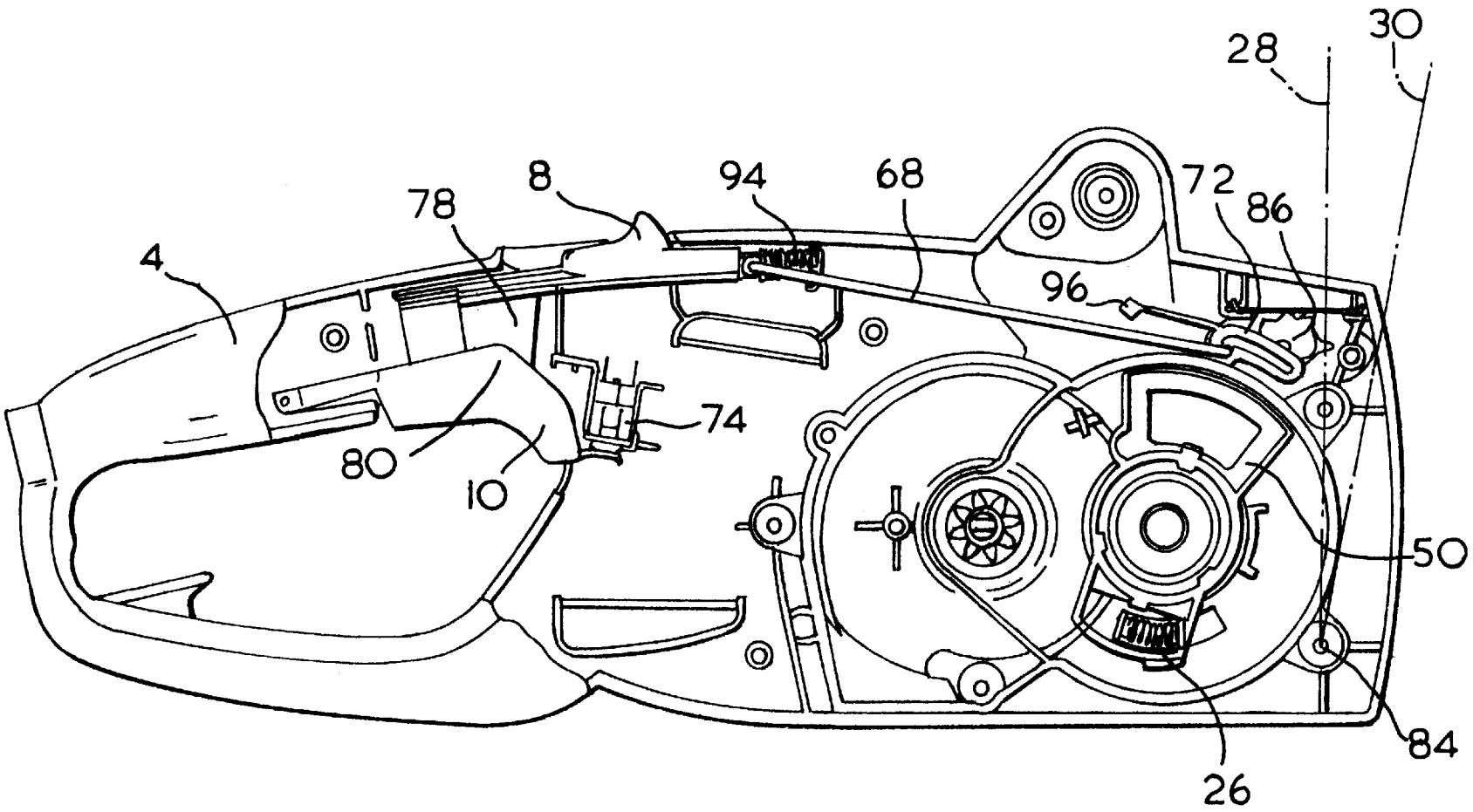
FIG. 11 shows a schematic diagram of a vertical cross-section of the chain saw in the plane of the gear actuator with the dog clutch engaged when viewed from the side of the chain saw in a direction generally indicated by Arrow B in FIG. 1.
Figure 12A:
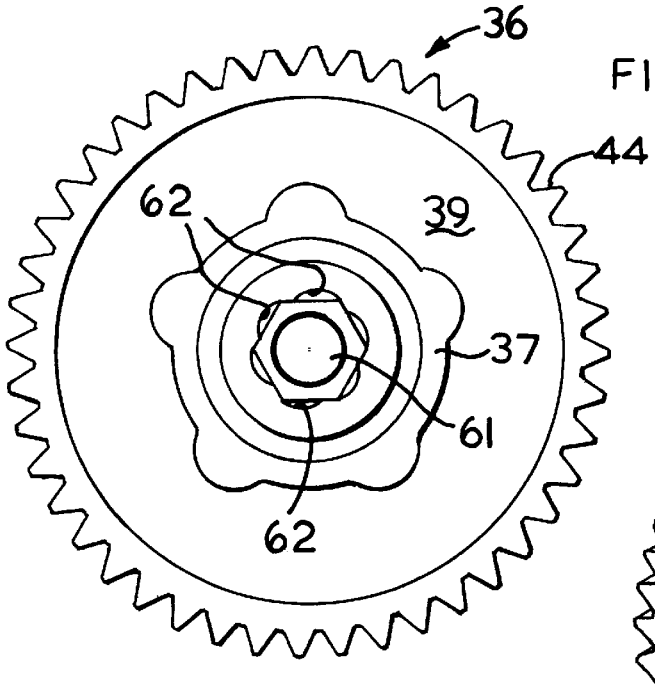
FIGS. 12A to 12D show design drawings of the drive gear.
Figure 12B:
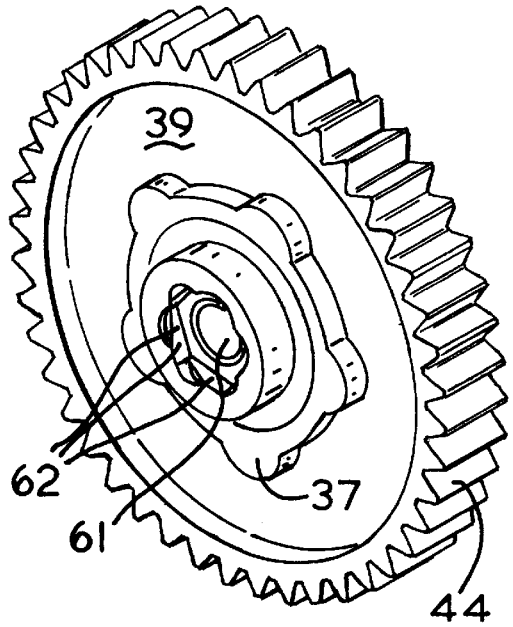
Figure 12C:
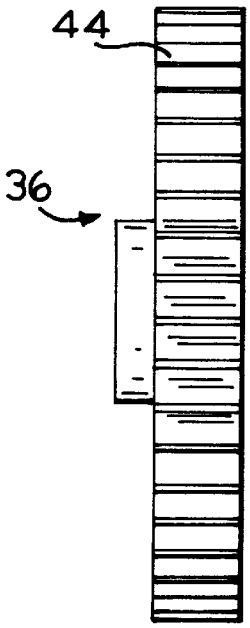
Figure 12D:
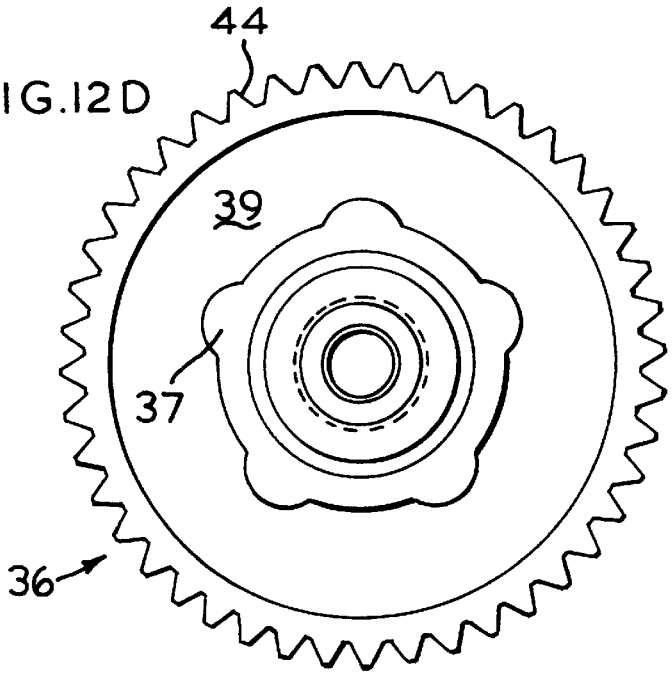

The cam ring (38) is mounted within a gear actuator (50) as shown more clearly in FIGS. 10 and 11. FIG. 14 shows a detailed design drawing for the gear actuator (50). Three teeth (52) on the gear actuator (50) project into three corresponding slots (54) on the cam ring (38) so that the gear actuator (50) and the cam ring (38) pivot in unison. The cam ring (38) is able to slide axially within the gear actuator (50) in the direction indicated by Arrow C shown in FIGS. 4, 5 and 9. The drive gear (36), which is biased towards the driven gear 32) by the spring (40), biases the cam ring (38) towards a wall (56) of the casing of the dog clutch (17). Mounted on the wall (56) in the zone where the cam ring (38) makes contact with the wall (56) are a plurality of ramps which mesh with a set of corresponding ramps (60) on a side of the cam ring (38). The biasing force of the drive gear (36) on the cam ring (38) biases the ramps (60) towards full engagement as shown in FIG. 5. As the cam ring (38) rotates, the ramps (60) on the side of the cam ring (38) ride up the ramps on the wall (56) and force the cam ring (38) to axially slide away from the wall (56) against the biasing force of the drive gear (36) as shown in FIGS. 7 and 9. This in turn forces the drive gear (36) to axially slide along the driven spindle (34) against the biasing force of the spring (40) away from the driven gear (32).

On the side of the drive gear (36) which makes contact with the driven gear (32) is a recess (61) which comprises a plurality of ramped dogs (62) which mesh with a set of corresponding peripheral surface (64) on the driven gear (32). FIG. 12 and FIG. 13 show the drive gear (36) and the driven gear (32) respectively in detail. When the drive gear (36) is fully biased by the spring (40) towards the driven gear (32), the ramped dogs (62) on the drive gear (36) mesh with the peripheral surface (64) on the driven gear (32) as indicated in FIG. 5. When the drive gear (36) is forced to slide axially away from the driven gear (32) by the rotating action of the cam ring (38), the ramped dogs (62) on the drive gear (36) and the peripheral surface (64) on the driven gear (32) become disengaged as indicated in FIG. 7. The drive gear (36) is able to rotatingly drive the driven gear (32), and hence the driven spindle (34), via the ramped dogs (62) and the peripheral surface (64) when they mesh together. When the ramped dogs (62) on the drive gear (36) are disengaged from the peripheral surface (64) on the driven gear (32), the drive gear (36) is able to freely rotate around the driven spindle (34). Ramped dogs (as opposed to teeth or castellations) have been used on the drive gear (36) so that, if they engage with the peripheral surface (64) when they are not aligned, as the drive gear (36) is rotated, the ramped dogs will slide smoothly into alignment and then mesh with the peripheral surface (64).

The shape of the gear actuator (50) is shown in FIG. 14. A spring (26) (shown in FIGS. 10, 11 and 17) biases the gear actuator (50) and hence the cam ring (38) to rotate in an anti-clockwise direction to cause the ramps (60) on the cam ring (38) to ride up the ramps on the wall (56) of the casing to their fullest extent, disengaging the ramped dogs (62) on the drive gear (36) from the peripheral surface (64) of the driven gear (32). The biasing force of the spring (26) is sufficient to override the biasing force of the spring (40) biasing the drive gear (36) against the driven gear (32).

The gear actuator (50) is manually pivoted against the biasing force of the spring (26) by a user sliding a sliding switch (8) mounted on the top of the rear handle (4) of the chain saw. The sliding switch (8) is connected to the gear actuator (50) via a metal rod (68) which connects with a groove (70) in the top (72) of the gear actuator (50). When the chain saw is not in use, the sliding switch (8) is biased towards the rear of the rear handle (4) by the gear actuator (50) via the metal rod (68) due to the biasing force of the spring (26), as shown in FIG. 10. When a user slides the sliding switch (8) forward, the gear actuator (50) and hence the cam ring (38) pivot against the biasing force of the spring (26) as shown in FIG. 11. Thus the user can engage the drive gear (36) with the driven gear (32) by sliding the sliding switch (8) forward. The trigger switch (10) is pivotably mounted on the inside of the handle (4). The trigger switch (10) activates the electrical power supply to the electric motor (16) by engaging an electrical switch (74). A spring (not shown) biases the trigger switch (10) away from the electrical switch (74). When the trigger switch 10) is depressed by the user, the end (76) of the trigger switch (10) engages the electrical switch (74) as shown in FIG. 11.

The sliding switch (8) and the trigger switch (10) are configured so that they interact with each other. When the chain saw is not being used, the trigger switch (10) is biased away from the electrical switch (74) and the sliding switch (8) is biased towards the rear of the rear handle (4) of the chain saw, as shown in FIG. 10. When the sliding switch (8) is in its rest position (FIG. 10) a ledge (78) of the sliding switch (8) abuts ledge (80) of the trigger switch (10) and hence prevents the trigger switch (10) from being depressed to actuate the electrical switch (74). The sliding switch (8) has to be moved forwards, for the ledge (78) to be removed from the path of the ledge (80) in order for a user to activate the electrical switch (74) by depressing the trigger switch (10), as shown in FIG. 11. When the trigger switch (10) is depressed, the front (82) of the ledge (80) moves into the path of the ledge (78) of the sliding switch (8) and thus prevents the sliding switch (8) from sliding back whilst the trigger switch (10) is depressed. This arrangement ensures that a user engages the dog clutch using the sliding switch (8) prior to applying electrical power to the electric motor (16) using the trigger switch (10).

The dog clutch is designed to interact with a pivotal handle guard (22) which is mounted on the front bail handle (20) of the chain saw. The handle guard (22) pivots about a point (84) between two positions indicated by the two lines (28) and (30). The axis of pivot which projects perpendicularly to the plane of drawings of FIGS. 10, 11 and 17 through point (84) of the handle guard (22) is parallel to that of the driven spindle (34). The handle guard (22) is a safety feature of the chain saw. In normal use, the handle guard (22) is positioned in the position indicated by the line (28). During the normal operation of the chain saw, the handle guard remains in this position at all times. However, sometimes the chain saw, in use, will "kick back". When this happens, the blade of the chain saw is thrown vertically upwards towards the head of the user. During "kick-back" the chain saw's acceleration is very great and either the inertia of the handle guard (22) or the back of the hand of the user holding the bail handle hits the pivotal handle guard (22) causes it to pivot to the position indicated by the line (30). The dog clutch is configured so that the pivotal movement of the pivotal handle guard (22) from position (28) to (30) causes the dog clutch to disengage the chain from the electric motor and hence to stop the chain regardless of the position of the sliding switch (8).

Figure 6:
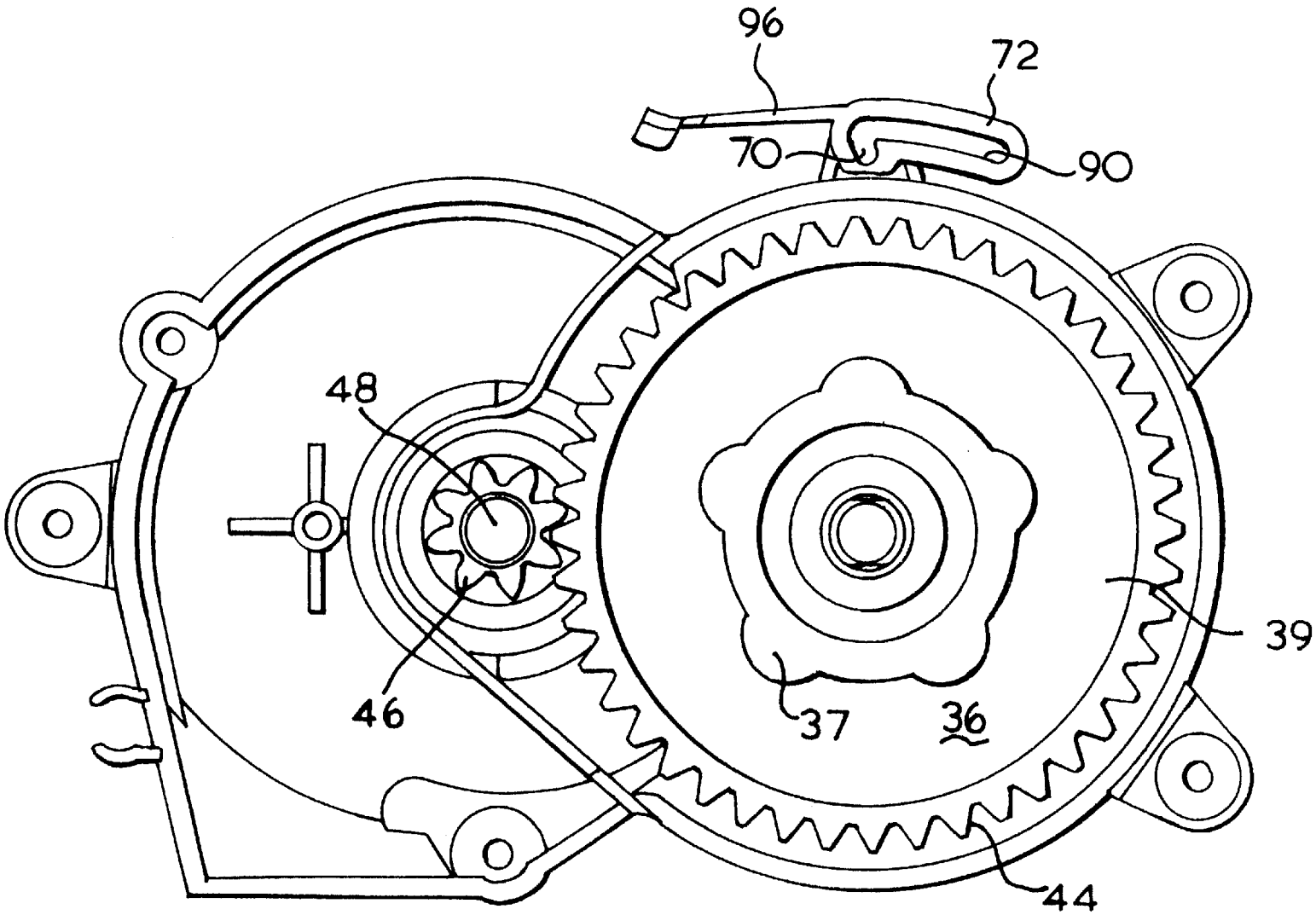
FIG. 6 shows a side view of the dog clutch when it is disengaged.

A guard actuator (86) is rigidly attached to the handle guard (22). The shape of the guard actuator (86) is shown in FIG. 9. The end of the metal rod (68) is bent at 90° to form a peg which sits in and passes through the groove (70) of the gear actuator (50). Above the groove (70) is a slot (90) which communicates with the groove (70). In normal operation the peg remains in the groove (70). The peg passes through the groove (70) and projects outwardly to the side of the gear actuator (50) as shown in FIG. 6. An arm (92) of the guard actuator (86) is positioned below the peg during normal use. During normal use of the chain saw the gear actuator (50) is pivoted under the action of the metal rod (68). When the handle guard (22) pivots due to a "kick back", the guard actuator (86) moves about the point (84). As it does so, the arm (92) of the guard actuator (86) knocks the peg out of the groove (70) and into the slot (90) as shown in FIG. 11. The gear actuator (50) pivots back under the biasing action of the spring (40), the peg sliding along the slot (90) as it does so. The pivoting action of the gear actuator (50) causes the dog clutch to become disengaged, this disengages the drive to the chain which will soon run down to a stop. This is a safety feature which brakes the chain when kick back occurs.

When the user releases the trigger switch (10), the sliding switch (8) is able to slide back. As the end of the metal rod (68) is disengaged from the groove (70), the biasing action of the spring (26) is unable to return the sliding switch (8) to its starting position. Therefore, a biasing spring (94) has been attached to the sliding switch (8) to force the sliding switch (8) and metal rod (68) back to its starting position. As the sliding switch (8) slides back towards the rear of the rear handle (4), the peg formed by the metal rod (68) slides along the slot (90) but is prevented from falling into the groove (70) by the arm (92). A spring (96) is formed integral with the gear actuator (50). The spring (96) makes contact with and biases the metal rod (68) towards the driven spindle (34) when the dog clutch (17) is disengaged so that the peg (88) is biased into the groove (70) regardless of the orientation of the chain saw. Whilst the handle guard (22) is in a position indicated by line (30) the gear actuator (50) is prevented from pivoting in response to movement of the sliding switch (8) because the peg is blocked by the arm (92) of the guard actuator (86). Therefore, the pivotal handle guard (22) has to be returned to the position indicated by line (28) so that it is below the level of the groove (70) so that the peg formed by the metal rod (68) can fall back into the groove (70) under the action of the spring (96). Only when the handle guard has been set in position (28) can the dog clutch (17) be engaged using the sliding switch (8) in order to drive the chain.

What is claimed is:

1. A chain saw comprising:

a motor that rotatingly drives a spindle via a clutch mechanism when the clutch mechanism is engaged;

a movable handle guard that interacts with the clutch mechanism to disengage the clutch mechanism, wherein the clutch mechanism is biased towards disengagement;

actuating means releasably connected to the clutch mechanism, the actuating means capable of overriding the biasing to engage the clutch when the actuating means is connected to the clutch; and the movable handle guard being configured to interact with a connection between the actuating means and the clutch mechanism, wherein when the movable handle guard is activated, the movable handle guard detaches the actuating means from the clutch mechanism.

2. The chain saw of claim 1, wherein the movable handle guard is configured so that when the actuating means is detached from the clutch mechanism, the actuating means is prevented from being re-attached until the movable handle guard had been reset.

3. The chain saw of claim 1, wherein the clutch mechanism comprises a gear actuator that pivots about a pivot axis between a first position in which the clutch mechanism is engaged and a second position in which the clutch mechanism is disengaged, the gear actuator having an arm extending away from the pivot axis, a slot formed in an end of the arm, a groove formed in the slot, the actuating mechanism comprising a peg capable of sliding along the slot and into and out of the groove and configured so that when the peg is located within the groove, the actuating mechanism is capable of pivoting the gear actuator to the first position and the movable handle guard comprising means to move the peg out of the groove into the slot when the movable handle guard is activated, the gear actuator being free to pivot between the first and second position when the peg is located within the slot.

4. The chain saw of claim 3, wherein the clutch mechanism is biased towards disengagement by a spring that biases the gear actuator towards the second position.

5. The chain saw of claim 3, wherein the peg is formed from a rod that extends beyond the groove and slot and the means to move the peg comprises a guard actuator attached to the movable handle guard, the guard actuator configured so that when the movable handle guard is activated, it engages with a part of the rod that extends beyond the gear actuator, thus moving the rod from the groove into the slot.

6. The chain saw of claim 5, wherein the guard actuator moves to a position in which the rod is prevented from re-entering the groove until the movable handle guard is reset.

7. The chain saw of claim 5, wherein the gear actuator comprises a spring which biases the peg into the groove when the peg is located at an entrance to the groove.

8. The chain saw of claim 7, wherein the spring is integrally formed with the gear actuator.

9. The chain saw of claim 1, wherein the actuating mechanism comprises a switch slidable between a first position where it engages the clutch and a second position where it disengages the clutch.

* * * * *